US009097471B2

(12) United States Patent
Beutler et al.

(10) Patent No.: US 9,097,471 B2
(45) Date of Patent: Aug. 4, 2015

(54) METHOD OF PRODUCING A HEAT EXCHANGER TUBE

(71) Applicant: Wieland-Werke AG, Ulm (DE)

(72) Inventors: Andreas Beutler, Weissenhorn (DE); Jean El Hajal, Ulm (DE); Ronald Lutz, Blaubeuren (DE)

(73) Assignee: WIELAND-WERKE AG, Ulm (DE)

( * ) Notice: Subject to any disclaimer, the term of this patent is extended or adjusted under 35 U.S.C. 154(b) by 0 days.

(21) Appl. No.: 14/470,158

(22) Filed: Aug. 27, 2014

(65) Prior Publication Data

US 2014/0366375 A1 Dec. 18, 2014

Related U.S. Application Data

(62) Division of application No. 12/592,210, filed on Nov. 20, 2009, now Pat. No. 8,899,308.

(30) Foreign Application Priority Data

Feb. 4, 2009 (DE) ..... 10 2009 007 446

(51) Int. Cl.

| | |
|---|---|
| ***F28F 1/42*** | (2006.01) |
| ***F28F 13/18*** | (2006.01) |
| ***B21C 37/20*** | (2006.01) |
| ***B21H 1/18*** | (2006.01) |
| ***B21H 3/08*** | (2006.01) |
| ***F28F 1/40*** | (2006.01) |
| ***B21D 53/06*** | (2006.01) |

(52) U.S. Cl.

CPC ..... *F28F 1/42* (2013.01); *B21C 37/207* (2013.01); *B21D 53/06* (2013.01); *B21H 1/18* (2013.01); *B21H 3/08* (2013.01); *F28F 1/40* (2013.01); *F28F 13/187* (2013.01); *Y10T 29/49382* (2015.01)

(58) Field of Classification Search

CPC ..... F28F 1/42; F28F 1/40; F28F 13/187; B21D 53/06; B21H 1/18; B21H 3/08; Y10T 29/49382

See application file for complete search history.

*Primary Examiner* — Moshe Wilensky

(74) *Attorney, Agent, or Firm* — Flynn, Thiel, Boutell & Tanis, P.C.

(57) ABSTRACT

A heat exchanger tube with a tube axis and with a tube wall having a tube outside and a tube inside, axially parallel or helically encircling inner ribs, with a groove which lies in each case between adjacent inner ribs, being formed from the tube wall on the tube inside, the helix angle, measured with respect to the tube axis, of the inner ribs being smaller than or equal to 45°, the region of the inner ribs which is remote from the tube wall being deformed at regular intervals asymmetrically on one side essentially in the tube circumferential direction, the deformed material of the inner ribs forming protrusions above the groove, the protrusions extending in each case over a finite deformation zone along an inner rib, the markedness of the deformation changing continuously within the deformation zone.

6 Claims, 5 Drawing Sheets

METHOD OF PRODUCING A HEAT EXCHANGER TUBE

Figure 1:
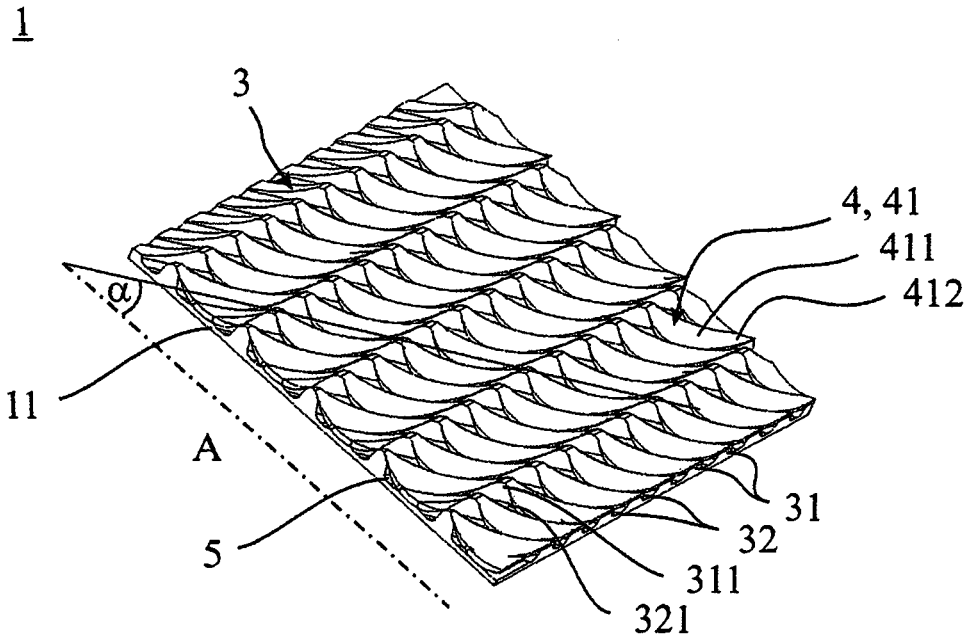

This is a divisional of prior U.S. application Ser. No. 12/592,210, filed Nov. 20, 2009.

The invention relates to a heat exchanger tube and to a method for producing it.

The evaporation of substances occurs in many sectors of refrigeration and air conditioning technology and also in chemical, process and power engineering. For evaporation, the evaporating substance requires heat which is extracted from another medium. The other medium in this case cools down or condenses. Mixed forms of cooling and condensation may also occur.

It is known that heat transfer can be intensified by means of the structuring of the heat transfer surface. What can be achieved thereby is that more heat can be transferred per unit of heat transfer area than in the case of a smooth surface. Furthermore, it is possible to reduce the driving temperature difference and consequently to make the process more efficient. Where metallic heat exchanger tubes are concerned, the structuring of the heat transfer surface often takes place by the forming of ribs or similar elements from the material of the tube wall. These integrally formed ribs have a firm metallic bond with the tube wall and can therefore transfer heat optimally.

Axially parallel or helical ribs are often used on the inside of tubes in order to improve the heat transfer properties. As a result of the ribbing, the inner surface of the tube is enlarged. Furthermore, where helically arranged ribs are concerned, the turbulence of the fluid flowing in the tube is increased and therefore heat transfer is improved. If the fluid flowing in the tube is to be evaporated, the inner ribs are provided with additional structural features in order to influence the evaporation process beneficially. Frequently, in this case, cavities or undercut structures are produced, since such structures assist the process of bubble formation.

By the inner surface of tubes being structured, not only is heat transfer intensified, but also the pressure drop of the medium flowing in the tube is increased. This effect is undesirable, especially in evaporation processes, since, along with the pressure, the evaporation temperature decreases and therefore the overall process becomes less efficient.

The publication JP 59202397 A proposes to bend the tips of the inner ribs round so as to give rise between adjacent ribs to a channel, the opening of which is narrower than its maximum width. Similar embodiments may be gathered from the publications EP 1 061 318 B1 and JP 05106991 A. In the two last-mentioned publications, in this case, not only is the tip of the inner ribs deformed, but the entire rib is bent round. EP 1 544 563 B1 proposes to deform the rib tip in such a way that the ribs acquire a T-shaped cross section and therefore undercut channels occur between the ribs. All four publications mentioned have in common that the cross section and the opening width of the undercut channels do not vary. Consequently, in a structure of this type, there is no location which is preferred for the formation and breakaway of bubbles.

Undercut structures, the cross-sectional shape and opening width of which vary, are more beneficial for the formation and stabilization of bubble evaporation. A structure with a varying opening width is described, for example, in publication JP 05253614 A. Material is displaced from the flanks of the inner ribs so that the channel between the ribs is partially closed. Steam bubbles can escape at the open points of the channel. However, the size of the openings can be controlled only very poorly, and the production process is not stable. This structure is therefore unsuitable for a cost-effective and performance-stable production of tubes.

Moreover, the publication U.S. Pat. No. 4,733,698 describes a structure in which material is displaced symmetrically out of the upper region of the rib by the radial impression of secondary grooves. The primary groove between the ribs is closed by the displaced material in the region of the secondary grooves. This gives rise to tunnel-like portions. So that sufficient material to close the primary groove is displaced, the secondary groove must have a sharply delimited trapezoidal cross-section. The sharp delimitation gives rise to a structure with pronounced edges which undesiredly increase the pressure drop of the flowing medium. A very similar structure is proposed in JP 04100633 A. The essential difference from U.S. Pat. No. 4,733,698 is the production method. Whereas, in U.S. Pat. No. 4,733,698, a tube is machined by means of a multistage drawing and forming process, in JP 04100633 A a strip is first structured which is subsequently shaped into a tube and welded along the longitudinal seam. However, the adverse properties of the structure are not eliminated by the other production process.

The object of the invention is to provide the inner surface of a tube with a structure which appreciably improves the heat transition during the evaporation of the medium flowing on the inside of the tube and at the same time does not excessively increase the pressure drop. Furthermore, the structure is to be capable of being produced cost-effectively and reliably.

The invention includes a heat exchanger tube with a tube axis and with a tube wall having a tube outside and a tube inside, axially parallel or helically encircling inner ribs, with a groove which lies in each case between adjacent inner ribs, being formed from the tube wall on the tube inside, the helix angle, measured with respect to the tube axis, of the inner ribs being smaller than or equal to 45°, the region of the inner ribs which is remote from the tube wall being deformed at regular intervals asymmetrically on one side essentially in the tube circumferential direction, the deformed material of the inner ribs forming protrusions above the groove, the protrusions extending in each case over a finite deformation zone along an inner rib, the markedness of the deformation changing continuously within the deformation zone, the deformation being marked to a greater extent in the middle of the deformation zone than at the margins, and cavities which assist the formation of bubbles being located between the groove bottom, the sides of the inner ribs and the protrusions formed.

The invention in this case is based on the consideration, especially in the case of a metallic heat exchanger tube with an integrally shaped structure on the tube inside, of improving the performance during the evaporation of substances on the tube inside.

The evaporating substance and the heat-discharging medium usually have to be separated materially from one another by means of a heat-transferring wall. For this purpose, metal tubes are often used. The evaporating substance may be located on the tube outside, while the heat-discharging medium flows on the tube inside. Alternatively, the evaporating substance flows on the tube inside and the heat-discharging medium is located on the outside of the tube. The present invention relates to the last-mentioned case.

In evaporation on the tube inside, the tubes may be arranged horizontally or vertically. Furthermore, there are cases where the tubes are inclined slightly with respect to the horizontal or vertical. In refrigeration technology, evaporators with horizontal tubes are usually employed. By contrast, in chemical engineering, vertical circulation evaporators are frequently used for heating distillation columns. The evaporation of the substance in this case takes place on the inside of vertically standing tubes.

In order to make heat transport between the heat-discharging medium and the evaporating substance possible, the temperature of the heat-discharging medium must be higher than the temperature of the evaporating substance. This temperature difference is designated as the driving temperature difference. The higher the driving temperature difference is, the more heat can be transferred. On the other hand, efforts are often made to keep the driving temperature difference low since this has benefits for the efficiency of the process.

According to the invention, to increase the heat transfer coefficient during evaporation, the process of bubble boiling is intensified. The formation of bubbles commences at germinating points. These germinating points are mostly small gas or steam inclusions. When the growing bubble has reached a specific size, it breaks away from the surface. If, during bubble breakaway, the germinating point is flooded with liquid, the germinating point is deactivated. The surface therefore has to be configured in such a way that, when the bubble breaks away, a small bubble remains which then serves as a germinating point for a new cycle of bubble formation. This is achieved in that, on the surface, cavities are arranged, in which a small bubble can remain after the breakaway of the bubble.

In the present invention, the cavities which are formed between the groove bottom, the sides of the ribs and the protrusions formed constitute the cavities according to the invention. The protrusions are formed by means of the zonal deformation of the upper rib regions. Deformation is in this case carried out such that the markedness of the deformation changes continuously within a zone, the deformation being marked to a greater extent in the middle of the deformed zone than at the margins of the deformed zone. This gives rise to a contour with curved boundary surfaces and without pronounced edges. A contour of this type is beneficial for the purpose of a low pressure drop, since the flow of the fluid is not deflected abruptly at edges, but, instead, the fluid can flow along the curved boundary surfaces.

The particular advantage is that the inner surface of a tube is provided with a structure which appreciably improves the heat transition during the evaporation of the medium flowing on the inside of the tube and which at the same time does not excessively increase the pressure drop. Furthermore, the structure can be produced cost-effectively and reliably.

In a preferred refinement of the invention, in the middle of the deformation zone, the deformed material of an inner rib can touch the circumferentially adjacent inner rib. As a result, the groove is provided partially with a cover in each case between adjacent ribs. Out of the initially open groove, therefore, a cavity is formed locally which extends parallel to the inner ribs and is open on two sides and which is delimited by the groove bottom, the flanks of the two contiguous inner ribs and the cover formed. The cross section of this cavity changes along the inner ribs in such a way that the cavity merges at both ends into the open groove in a funnel-like manner. Between the two funnel-shaped transitions, the cavity possesses a point having the smallest cross-section. Preferably small bubbles or gas inclusions can dwell at this point. These form preferred germinating points for the formation of large bubbles, with the result that the evaporation process is accelerated.

Advantageously, in the middle of the deformation zone, the deformed material can touch the groove bottom between the inner ribs and the circumferentially adjacent inner rib, with the result that the groove is partially closed between adjacent inner ribs. The partial closing gives rise to funnel-like cavities which particularly assist the formation of bubbles. Since the cavities formed in this embodiment have only one opening, liquid cannot flow in, unimpeded, when a bubble has broken away. Conditions are thereby afforded which are particularly conducive to small bubbles or gas inclusions remaining behind. These small bubbles or gas inclusions form preferred germinating points for the generation of new bubbles even when the driving temperature differences are small.

In a preferred refinement, adjacent protrusions of the inner ribs do not touch or overlap one another in the helical circumferential direction. The width of the deformed zone is usually selected such that the original height H of the inner rib is maintained between the adjacent zones of the protrusions. This assists the swirling of the fluid flowing in the tube.

Advantageously, helically encircling integrally formed outer ribs may be produced on the tube outside. In tube types ribbed on both sides in this way, the heat transfer surface is increased, so that correspondingly more heat can be transferred than in the case of a smooth surface.

A further aspect of the invention includes a method for producing a heat exchanger tube according to the invention, with integral outer ribs helically encircling on the tube outside and with integral inner ribs which run axially parallel or helically on the tube inside and of which the region remote from the tube wall is deformed at regular intervals asymmetrically on one side in the tube circumferential direction, the following method steps being performed:

a) helically running outer ribs are formed on the tube outside of a smooth tube, in that the rib material is obtained as a result of the displacement of material out of the tube wall by means of a rolling step, and the ribbed tube occurring is set in rotation by the rolling forces and is pushed forward corresponding to the ribs occurring, the outer ribs being shaped with a rising height out of the otherwise non-deformed smooth tube, b) the tube wall is supported, in the region in which the outer ribs are formed, by a rolling mandrel with lies in the tube and which is mounted rotatably on a mandrel rod and has axially parallel or helical grooves on its mandrel outer surface, axially parallel or helical inner ribs being formed, c) the region of the inner ribs which is remote from the tube wall is deformed at regular intervals asymmetrically essentially in the tube circumferential direction by means of at least one non-rotatable pin following the rolling mandrel, the deformed material of the inner ribs being displaced in such a way that it forms protrusions above the groove between two adjacent inner ribs.

The invention is in this case based on the consideration that a rolling device is used which consists of n=3 or 4 toolholders, into each of which at least one rolling tool is integrated. The axis of each toolholder runs obliquely with respect to the tube axis. The toolholders are in each case arranged, offset at 360°/n, on the circumference of the tube. The toolholders can be advanced radially. They are arranged, in turn, in a fixed rolling stand. The rolling tools consist of a plurality of rolling disks which are arranged next to one another and the diameter of which rises in the direction of the progressive degree of forming of the outer ribs.

A profiled rolling mandrel is likewise an integral part of the device. This is attached to a rod and is mounted rotatably on the latter. The axis of the rolling mandrel is identical to the axis of the rod and coincides with the tube axis. The rod is fastened at its other end to the rolling stand and is fixed such that it cannot rotate. By means of the rod, the rolling mandrel is positioned in the operating range of the rolling tools.

Furthermore, following the rolling mandrel, at least one pin oriented in the radial direction is attached. The pin is connected fixedly to the rod and is therefore non-rotatable. The non-rotatable pin therefore engages into the inner ribs which are first formed by the rolling mandrel outer surface, thus giving rise to protrusions. These protrusions are shaped at regular intervals asymmetrically essentially in the tube circumferential direction. In this context, the term "essentially" reflects the fact that the rolling disks of the rolling tool which engage on the tube outer wall impart a certain, but low forward push to the tube per revolution. Thus, with an extremely low axial displacement, the fixed pin arranged on the mandrel rod executes in the heat exchanger tube a movement which corresponds approximately to the tube circumferential direction.

In a preferred refinement of the invention, the end of the pin may have a rounded contour. The markedness of the deformation changes according to the contour of the pin, so that there are regions with pronounced and with less pronounced deformation. The rounded contour avoids the situation where the protrusions formed have sharp edges at the transition of regions of differing deformation.

Advantageously, the end of the pin may be in the form of a hemisphere. The markedness of the deformation changes continuously within a deformation zone according to this hemispherical shape, without sharp edges occurring. In a similar way to a trough, the deformation in the middle of the deformed zone is marked to a greater extent than at its margins. The protrusions consequently assume a tongue-like shape.

In a further preferred refinement of the invention, the radial extent of the pin, measured from the axis of the rod as far as the end of the pin, may at most be as large as half the diameter of the rolling mandrel. This limitation avoids the situation where the deformation of the inner ribs extends into the core wall of the ribbed tube and therefore reduces the stability of the tube. The smaller the radial extent of the pin is, the lesser is the extent to which the inner ribs are deformed and the less material is displaced laterally. The intensity of deformation can therefore be appreciably influenced by the choice of the radial extent of the pin.

Advantageously, the radial extent of the pin, measured from the axis of the rod as far as the end of the pin, may be smaller than half the mandrel diameter of the rolling mandrel by 35% to 65% of the height of the non-deformed inner ribs. In the case of inner rib heights of, for example, 0.4 mm, the radial extent of the pin, measured from the axis of the rod as far as the end of the pin, may therefore be 0.14 to 0.26 mm smaller than half the diameter of the rolling mandrel. If the radial extent of the pin is smaller than half the mandrel diameter minus 65% of the height of the non-deformed inner ribs, the deformation of the inner ribs is insufficiently marked, and therefore no adequate improvement in heat transfer can be achieved. If the radial extent of the pin is smaller than half the mandrel diameter minus 35% of the height of the non-deformed inner rib height, the deformation of the inner ribs is such that the cavities occurring have a shape which is especially advantageous for the formation of bubble germinating points.

To machine the tube, the rotating rolling tools arranged on the circumference are advanced radially to the smooth tube and brought into engagement with the smooth tube. The smooth tube is thereby set in rotation about its axis.

Since the axes of the rolling tools are set obliquely with respect to the tube axis, the rolling tools form helically encircling outer ribs from the wall material of the smooth tube and at the same time push the ribbed tube occurring forward corresponding to the pitch of the helically encircling outer ribs. The distance, measured longitudinally with respect to the tube axis, between the centers of two adjacent outer ribs is designated as the rib division p. The rib division p usually amounts to between 0.4 and 2.2 mm. The outer ribs encircle preferably in the manner of a multi-flight thread. If m thread flights are generated per revolution of the tube, the forward push of the tube in the axial direction then amounts to m·p per revolution. In the case of small divisions p of the outer rib, m usually assumes the values 3, 4, 6 or 8.

In the operating range of the rolling tools, the tube wall is supported by the profiled rolling mandrel. The profile of the rolling mandrel usually consists of a multiplicity of essentially trapezoidal grooves which are arranged parallel to one another on the outer surface of the rolling mandrel. The grooves run at a twist angle of 0° to 45° with respect to the axis of the rolling mandrel. By means of the radial forces of the rolling tool, the material of the tube wall is pressed into the grooves of the rolling mandrel. As a result, axially parallel or helically encircling inner ribs are formed on the inner surface of the tube. The twist angle, measured with respect to the tube axis, of the inner ribs is equal to the twist angle of the grooves of the rolling mandrel. The height H, measured from the tube wall, of the inner ribs preferably amounts to between 0.3 and 0.5 mm. Grooves run between two adjacent inner ribs.

After the operating range of the rolling tools, the inner ribs are machined further by the pin attached behind the rolling mandrel. The pin is positioned fixedly by the rod, while the tube having the formed inner ribs rotates about its own axis. The radial extent of the pin is selected such that the region of the inner ribs which is remote from the tube wall is deformed at regular intervals asymmetrically essentially in the tube circumferential direction by that end of the pin which points in the radial direction. The material of the inner ribs is displaced laterally and the height of the inner ribs is reduced locally as a result of the deformation. The laterally displaced material of the inner ribs forms protrusions above the groove between two adjacent inner ribs. The deformation extends in each case over a finite zone along the inner rib according to the width of the pin. Since the end of the pin has a rounded contour, the markedness of the deformation changes continuously within a zone. In a similar way to a trough, the deformation is marked to a greater extent in the middle of the deformed zone than at its margins. If only one pin is used for deforming the inner ribs, the distance, measured in the axial direction, between the centers of two adjacent deformation zones along an inner rib is equal to the axial forward push (m·p) which the tube executes per revolution. If a plurality of pins are used, this distance is reduced according to the number of pins.

Figure 2:
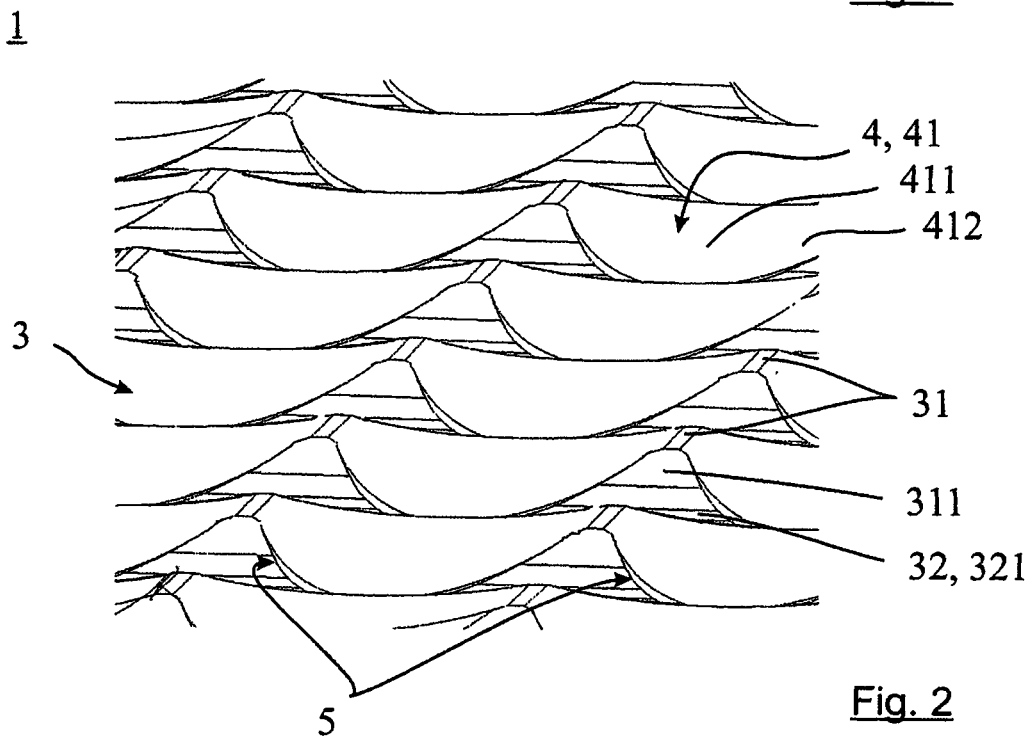
Figure 3:
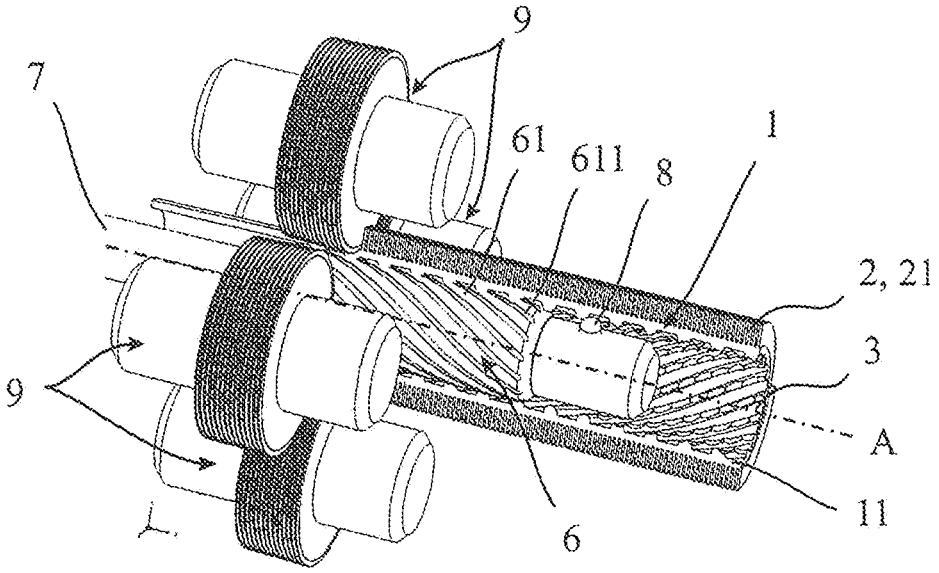
Figure 4:
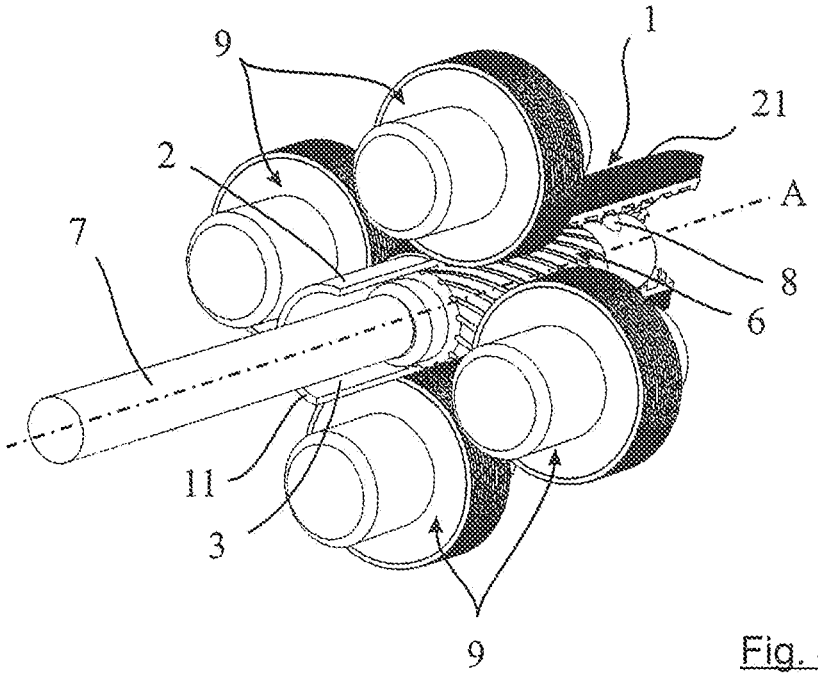
Figure 5:
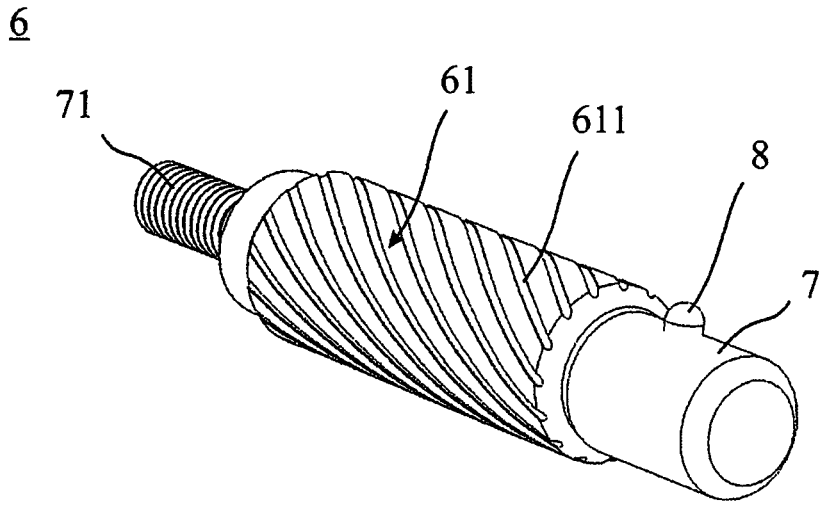
Figure 6:
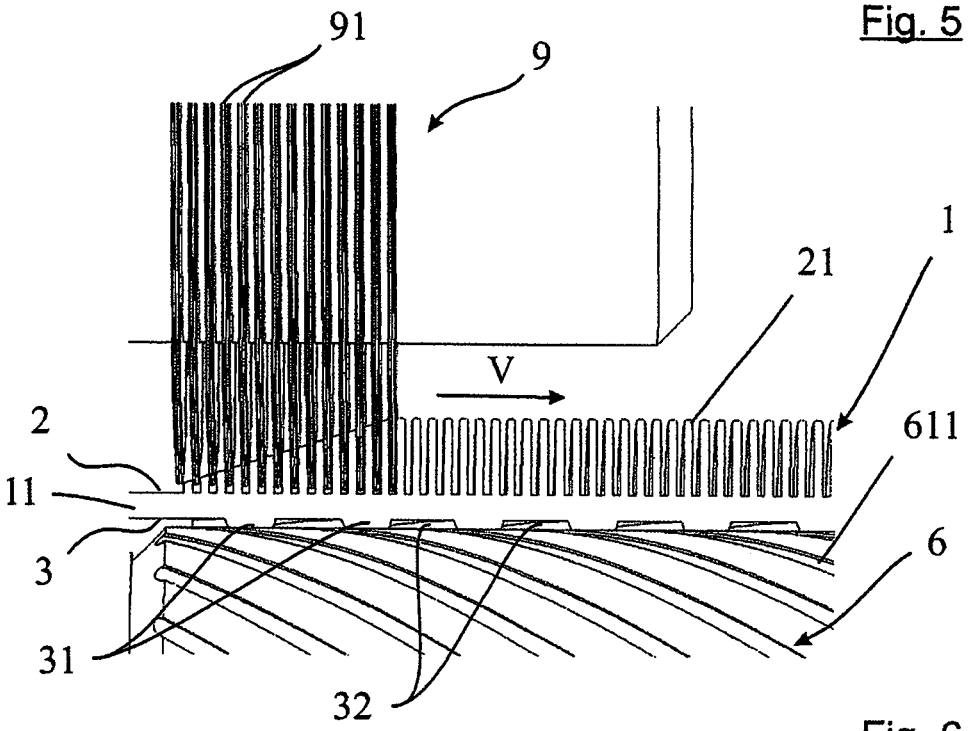
Figure 7:
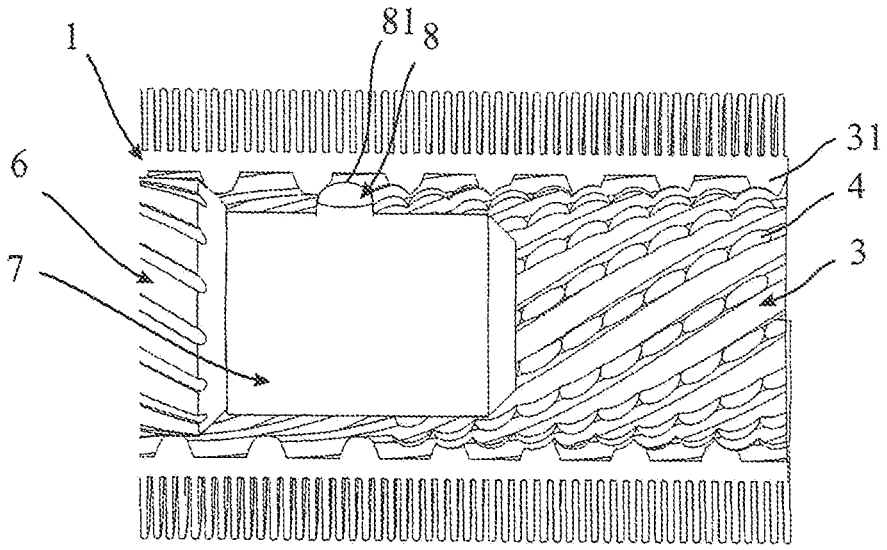
Figure 8:
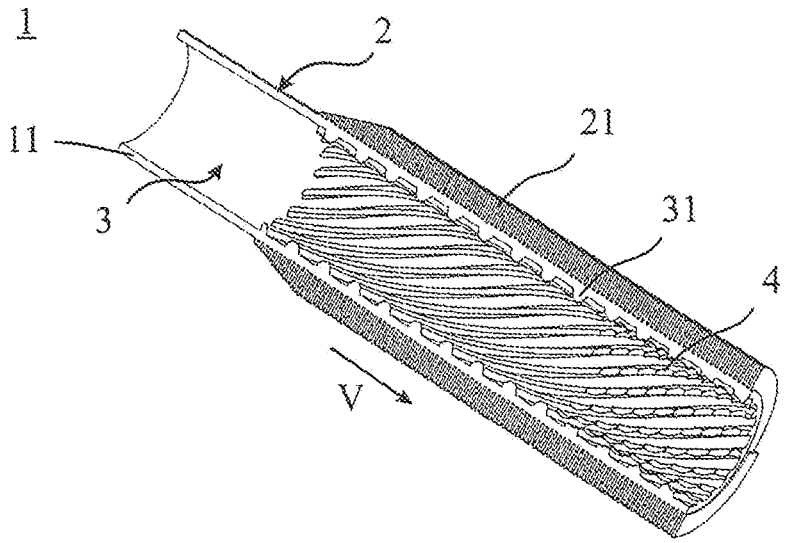
Figure 9:
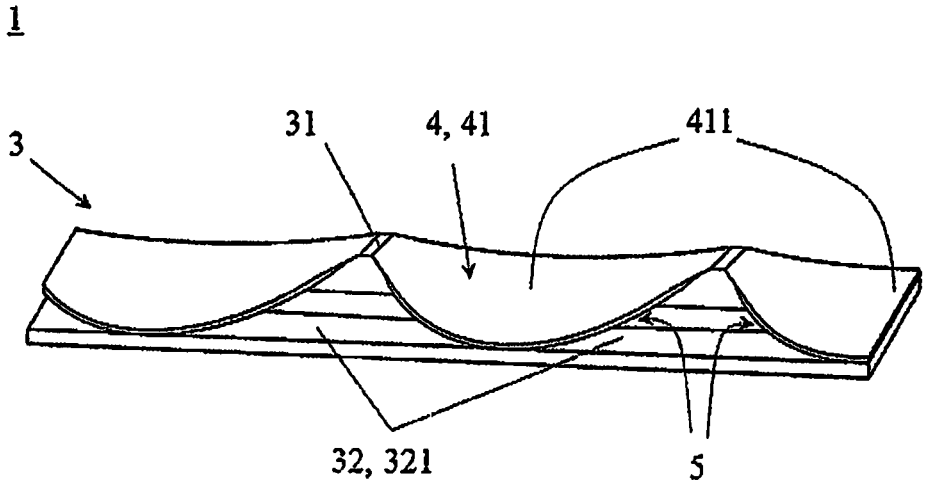

Exemplary embodiments of the invention are explained in more detail with reference to diagrammatic drawings in which:

FIG. 1 shows a view of the structure on the tube inside of a tube segment spread out flat, FIG. 2 shows a view of a detail of the inner structure of a tube segment according to FIG. 1, FIG. 3 shows the production of a heat exchanger tube ribbed on both sides by means of a rolling mandrel and four outer rolling tools, FIG. 4 shows the production of a heat exchanger tube ribbed on both sides, according to FIG. 3, from a further perspective, FIG. 5 shows a rotatably mounted rolling mandrel with a non-rotatable pin, FIG. 6 shows a view of a detail in the region of the outer rolling tools, FIG. 7 shows a further view of a detail in the region of the pin, FIG. 8 shows a view of a heat exchanger tube cutaway on one side and ribbed on both sides, with different stages in the production of the inner structure, and FIG. 9 shows a part of the inner surface of a heat exchanger tube according to the present invention.

Parts corresponding to one another are given the same reference symbols in all the figures.

FIG. 1 shows a view of the structure on the tube inside 3 of a tube segment, spread out flat, of a heat exchanger tube 1. The tube axis A in this case runs parallel to one of the cut edges of the tube segment. The helix angle $\alpha$, measured with respect to the tube axis A, of the inner ribs 31 amounts to approximately 35°. The region of the inner ribs 31 which is remote from the tube wall 11, that is to say, essentially, the region of the rib tips, is deformed at regular intervals asymmetrically on one side in the tube circumferential direction. The deformed material of the inner ribs 31 forms protrusions 4 which extend above the groove 32. A small residue of an inner rib 31 remains non-deformed at the margins 412 of the deformation zones 41 between adjacent protrusions 4, so that adjacent protrusions 4 of the inner ribs 31 are spaced apart a little in the helical circumferential direction and do not touch one another.

In the middle 411 of the deformation zone 41 of a protrusion 4, the deformed material touches the circumferentially adjacent inner rib 31, with the result that the groove 32 is partially closed between adjacent inner ribs 31. A cavity 5 which is open on two sides is thus formed locally out of the originally open groove 32, the said cavity extending parallel to the inner ribs and being delimited by the groove bottom 321, the sides 311 of the two contiguous inner ribs 31 and of the protrusion 4 as a cover.

Also, in the middle 411 of the deformation zone 41, the deformed material may extend even as far as the groove bottom 321 between the inner ribs 31, with the result that virtually two cavities 5 separated by a partition occur below each protrusion 4.

FIG. 2 shows a view of a detail of the inner structure of a tube segment of a heat exchanger tube 1 according to FIG. 1. On the tube inside 3, inner ribs 31 are arranged, with regularly recurring protrusions 4 which are distributed over the surface and below which cavities 5 are formed. Bubble formation is assisted inside a cavity 5. However, germinating bubbles occurring, limited by a protrusion 4, must grow laterally along the sides 311 of the inner ribs 31 and along the groove 32 on the groove bottom 321, before they can break away via inwardly open regions between the protrusions 4 from the heat exchanger tube 1 by way of funnel-like openings.

That part of a device which is illustrated in FIGS. 3 and 4 makes clear, in different perspectives, the production of a heat exchanger tube 1 ribbed on both sides. The integrally rolled heat exchanger tube 1 has helically encircling outer ribs 21 on the tube outside 2. A device is used which consists of four rolling tools 9 which are arranged on the circumference of the heat exchanger tube 1. The rolling tools 9 are set obliquely somewhat with respect to the tube axis A, in order to generate the necessary forward push of the tube, and can be advanced radially. They are arranged, in turn, in a fixed rolling head which is itself fixed in the basic stand of the rolling device (not illustrated in the figures).

The rolling mandrel 6, with the aid of which the inner structure of the heat exchanger tube 1 is generated, is likewise an integral part of the rolling device. The rolling mandrel 6 is attached to the free end of a mandrel rod 7 and is mounted rotatably. The mandrel rod 7 is fastened at its other end to the basic stand, not illustrated in the figure, of the rolling device. The mandrel rod 7 must be at least as long as the heat exchanger tube 1 to be produced.

To machine the originally smooth tube, the rotating rolling tubes 9 arranged on the circumference are advanced radially to the smooth tube and are brought into engagement with the smooth tube. The smooth tube is thereby set in rotation. Since the axis of each of the rolling tools 9 is set obliquely with respect to the tube axis, the rolling tools 9 form helically encircling outer ribs 21 out of the tube wall 11 of the smooth tube and at the same time push the heat exchanger tube 1 occurring forward according to the pitch of the helically encircling outer ribs 21.

In the forming zone of the rolling tools 9, the tube wall 11 is supported by the profiled rolling mandrel 6. The axis of the rolling mandrel 6 is identical to the tube axis A. The rolling mandrel 6 is profiled with helical grooves 611 on the mandrel outer surface 61. At the end of the mandrel rod 7, a pin 8 in the form of a hemisphere is arranged, of which the radial extent, measured from the axis of the rod 7 as far as the outer end of the pin 81, is at most as large as half the diameter of the rolling mandrel 6. This pin 8 engages into the material of the inner ribs of the tube inside 3 and in the rotating heat exchanger tube 1 forms the protrusions 4 illustrated in FIGS. 1 and 2.

FIG. 5 shows a rotatably mounted rolling mandrel 6 with a non-rotatable pin 8 at the end of a two-part mandrel rod 7. The thread 71 connects the rod parts positively so as to form a stable structure suitable for use. The rolling mandrel 6 is profiled with helical grooves 611. The profile usually consists of a multiplicity of trapezoidal or almost trapezoidal grooves which are arranged parallel to one another on the mandrel outer surface 61 with a twist. In the rolling mandrel 6 illustrated, the twist angle amounts to approximately 35°.

FIG. 6 shows a view of the detail of the device in the region of the outer rolling tools 9. The rolling tools 9 consist in each case of a plurality of rolling disks 91 which are arranged next to one another and the diameter of which rises in the forward pushing direction V. By means of the radial forces of the rolling tools 9 upon the outside 2, the material of the tube wall 11 on the tube inside 3 is pressed into the helical grooves 611 of the rolling mandrel 6. As a result, helically encircling inner ribs 31 are formed on the inner surface of the heat exchanger tube 1, before the pin which follows during the method shapes the protrusions (not illustrated in this figure). Grooves 32 run between two adjacent inner ribs 31.

FIG. 7 shows a further view of a detail of the heat exchanger tube 1 and of the rolling mandrel 6 and the end of the mandrel rod 7 in the region of the pin 8. There, the inner ribs 31 formed by the rolling mandrel 6 are shaped, in that the protrusions 4 are introduced into the tube inside 3. The pin 8 has a hemispherical configuration, the radial extent of the pin 8, measured from the axis of the rod 7 as far as the end of the pin 81, being smaller than half the diameter of the rolling mandrel 6. In structures with inner rib heights of, for example, 0.4 mm, the radial extent of the pin 8, measured from the axis of the rod as far as the end of the pin 81, is 0.14 mm to 0.26 mm smaller than half the diameter of the rolling mandrel 6.

FIG. 8 shows a view of a heat exchanger tube 1 cut open on one side and ribbed on both sides, with different stages in the production of the structure on the tube inside 3. The outer ribs 21 worked out from the tube wall 11 on the tube outside 2 have mostly a greater rib height than the inner ribs 31. It can be seen clearly in the forward pushing direction V how, starting from a smooth tube, first the outer ribs 21 and inner ribs 31 are formed and, as the method continues, the protrusions 4 are produced.

FIG. 9 shows a part of the inner surface of a heat exchanger tube according to the present invention where the middle (411) of the deformation zone (41), the deformed material touches the groove bottom (321) between the inner ribs (31) and a circumferentially inner rib (31) with the result that the groove (32) is partially closed between adjacent inner ribs (31).

LIST OF REFERENCE SYMBOLS

1 Heat exchanger tube
11 Tube wall
2 Tube outside
21 Outer ribs
3 Tube inside
31 Inner ribs
311 Sides of the inner ribs
32 Groove
321 Groove bottom
4 Protrusions
41 Deformation zone
411 Middle of the deformation zone
412 Margins of the deformation zone
5 Cavity
6 Rolling mandrel
61 Mandrel outer surface
611 Helical grooves
7 Mandrel rod
71 Thread of a two-part mandrel rod
8 Pin
81 End of the pin
9 Rolling tool
91 Rolling disks
A Tube axis
V Forward pushing direction
α Helix angle

What is claimed is:

1. A method for producing a heat exchanger tube having a tube axis, a tube wall having a tube outside and a tube inside, helically encircling integral outer ribs formed on the tube outside and axially parallel or helically encircling inner ribs formed on the tube inside, with a groove which lies in each case between adjacent inner ribs, a region of each of the inner ribs which is remote from the tube wall being deformed asymmetrically on only one side essentially in a tube circumferential direction, comprising the steps of:

a) performing a rolling step on an outside tube wall of a smooth tube so that a rib material is formed by the displacement of material out of the outside tube wall to form helically extending outer ribs on the tube outside tube wall to obtain a ribbed tube which is set into rotation and propelled forwardly during the formation of the outer ribs, the outer ribs being shaped with a rising height out of an otherwise non-deformed smooth tube surface;

b) supporting an inside tube wall in a region in which the outer ribs are formed with a rolling mandrel provided in the ribbed tube and mounted rotatably on a mandrel rod and having axially parallel or helical grooves on an outer surface thereof and forming axially parallel or helical inner ribs on the inside tube wall to form an inner and outer ribbed tube; and c) deforming a region of each of the inner ribs which is remote from the inside tube wall at regular intervals asymmetrically on only one side essentially in a circumferential direction of the inner and outer ribbed tube by means of a pin provided on the mandrel rod, deformed material of the inner ribs being displaced to form protrusions above a groove provided between adjacent inner ribs to form the heat exchange tube.

2. The method for producing a heat exchanger tube according to claim 1, characterized in that an end of the pin has a rounded contour.

3. The method for producing a heat exchanger tube according to claim 2, characterized in that the end of the pin is in the form of a hemisphere.

4. The method for producing a heat exchanger tube according to claim 1, characterized in that a radial extent of the pin, measured from an axis of the mandrel rod as far as an end of the pin, is at most as large as half the diameter of the rolling mandrel.

5. The method for producing a heat exchanger tube according to claim 1, characterized in that a radial extent of the pin, measured from an axis of the mandrel rod as far as an end of the pin, is smaller than half the diameter of the rolling mandrel by 35% to 65% of the height of non-deformed inner ribs.

6. The method for producing a heat exchanger tube according to claim 5, characterized in that the radial extent of the pin, measured from the axis of the rod as far as the end of the pin, is 0.14 to 0.26 mm smaller than half the diameter of the rolling mandrel.

* * * * *